United States Patent [19]

Baumann

[11] 4,125,918

[45] Nov. 21, 1978

[54] FASTENER FOR LACE SHOES

[76] Inventor: Allan H. Baumann, Box 81, Wendover, Ontario, Canada, K0A 3K0

[21] Appl. No.: 681,159

[22] Filed: Apr. 28, 1976

[30] Foreign Application Priority Data

Apr. 30, 1975 [CA] Canada ..... 225750

[51] Int. Cl.[2] ..... A43C 1/00

[52] U.S. Cl. ..... 24/117; 24/144

[58] Field of Search ..... 24/144, 148, 146, 105, 24/117 A, 117 R, 118, 127

[56] References Cited

U.S. PATENT DOCUMENTS

| | | | |
|---|---|---|---|
| 249,781 | 11/1881 | McBride | 24/105 |
| 295,032 | 3/1884 | Matthews | 24/105 |
| 338,470 | 3/1886 | Blaney | 24/117 R |
| 386,002 | 7/1888 | Dahlberg | 24/105 |
| 736,306 | 8/1903 | Smith | 24/118 |
| 889,301 | 6/1908 | Ellis | 24/117 R |
| 1,266,867 | 5/1918 | Sebenius | 24/105 |
| 1,573,119 | 2/1926 | Pambianco | 24/146 |
| 1,594,416 | 8/1926 | Kellog | 24/105 |
| 1,825,029 | 9/1931 | Trub | 24/105 |

FOREIGN PATENT DOCUMENTS

| | | | |
|---|---|---|---|
| 69,769 | 3/1915 | Austria | 24/105 |
| 796,223 | 4/1936 | France | 24/117 R |
| 164,529 | 12/1933 | Switzerland | 24/117 |
| 4,857 of | 1901 | United Kingdom | 24/118 |

*Primary Examiner*—Bernard A. Gelak

[57] ABSTRACT

A fastener for lace shoes and the like for utilization in combination with a tied shoe lace, comprising a flat base and a conjoined stem thereon suitable for insertion into a lace hole and a button attachable to the stem after insertion into the lace hole, for attaching the fastener to a flap of the shoe, a tapered configuration on the button providing means for retaining a free loop of the tied shoelace around the button when in use, yet permitting easy removal of the loop from the button so that the flaps of the shoe may be moved apart for removal of the shoe from a foot, means for directing the pressure, caused by the pull of the lace, upwards into the shoe material rather than downwards into the foot, means for retaining the flat base in an orientation to maintain above direction of pressure, means for preventing inadvertent disengagement of the button from the stem, means to facilitate relocation of the loop on the button, means for locating the button over a lace eyelet on a lace hole to ensure contact between button and flap material, and means for firmly attaching the fastener on a shoe having an unusually thin flap.

2 Claims, 3 Drawing Figures

1
2
7
4
3
5
6
11
12
10
13

33
24
29
1
34
28
25
21
22
27
26
32
31

20
1
12
29
24
33
34
28
25
21
27
26
22
31
32

FASTENER FOR LACE SHOES

This invention relates, in general, to shoe fastening means and in particular to a fastening means for conventional lace shoes which may be quickly and easily operated by using only one hand.

A number of alternatives to the tying and untying of laces is available.

Elastic shoelaces and loafer-type shoes with elastic closures are unsuitable for some persons because they do not provide sufficiently firm support, and for others because the constant pressure of the elastic may be irritating or may interfere with circulation.

My invention overcomes these problems by using conventional shoelaces which provide firm support without élastic pressure.

Buckles may be unsuitable for some persons as the number of tension settings is limited by the spacing of holes in the strap, and as a certain amount of manual dexterity is required to operate them.

My invention overcomes these problems by using conventional laces which may be adjusted to any tension desired, and by being so simple in operation that a handicapped person unable to reach his foot with his hand can operate it by the use of a hook on the end of a stick.

One device presently used by handicapped persons is a molded plastic zipper which is laced into the shoe closure. Being bulky and unsightly, they offend the handicapped person by pointing out that he is different from others. My invention overcomes this problem by presenting a normal appearance of the shoe as it is noticeble only under close scrutiny. Furthermore, such zippers commonly break after a few months due to the compressive stresses inherent in their operation. My invention does not suffer from this type of stress and has been proven durable in extensive testing.

Various clamping and buckling devices have appeared on the market and subsequently disappeared due to their complexity and consequent expense, and their tendency to mechanical failure. My invention, on the other hand, is simple, reliable and inexpensive.

While hooks and the like have been used in lieu of eyelets to receive a loop of shoelace, they have been used, usually in series, for the rapid lacing of the boot or shoe, rather than as a tension adjusting means, since it is too difficult to remove the loop of lace from the hook while the laces are tied.

My invention overcomes this problem by providing a surface which effectively holds the lace, as a hook does, but which requires very little pulling force to free the lace when desired.

Consequently it is an object of the invention to provide a simple, inexpensive, durable fastener which permits lace shoes to be fastened and loosened quickly and easily by the use of only one hand and which does not materially alter the normal appearance of the shoes.

It is further an object of the invention to provide a fastener which can be quickly and easily installed without tools on any lace shoe of normal design regardless of the number of eyelets on the shoe, or which may equally well be installed as original equipment by the shoe manufacturer.

It is an object of this invention to provide a shoe closure which can be operated by small children not yet able to tie shoelaces, pregnant women and overweight and aged persons who have difficulty reaching their feet with both hands, handicapped persons who have the use of only one hand, and handicapped persons who can reach their feet only by using a reaching aid.

Another object of this invention is to provide a faster and easier alternative to nurses, kindergarten teachers, mothers and others who presently have to tie laces for persons dependent on them.

It is further an object of this invention to provide a fastener incorporating a unique supporting base structure which, without transmitting stresses to the foot, and without further modifications of conventional lace shoe, counteracts the eccentric pull of the shoelaces which might otherwise tip the fastener out of its proper orientation.

Another object of the invention is to provide a fastener which can be manufactured by injection molding entirely of one material in a single operation and which is consequently simple and inexpensive to manufacture in large quantities.

While it is understood that the invention is in no way restricted to the exact form described below, the following illustrations and description refer to a preferred embodiment of the invention made of plastic by injection molding, which is suitable for installation by the consumer on a conventional lace shoe.

Referring now to the diagrams,

Figure 1:
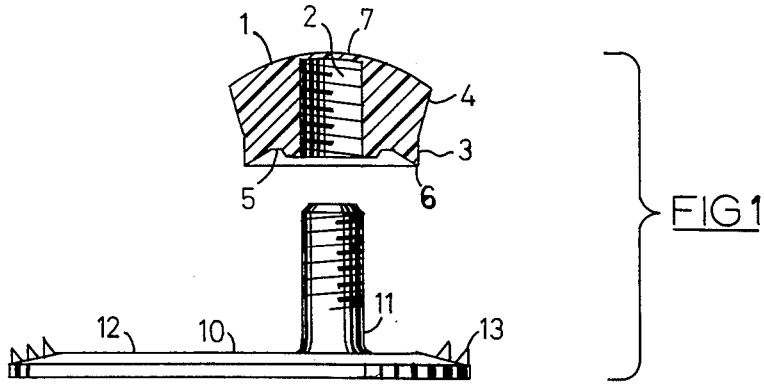
FIG. 1 is an elevation of the fastener prior to assembly, with the button shown in section.
Figure 2:
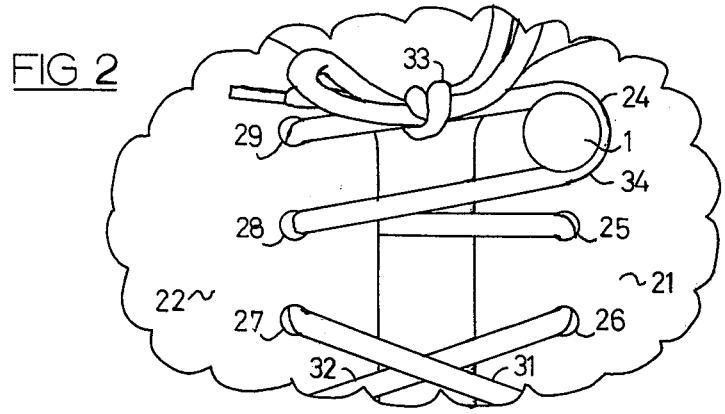
FIG. 2 is a schematic plan view of the upper portion of a lace shoe closure in the closed position, with the fastener installed.
Figure 3:
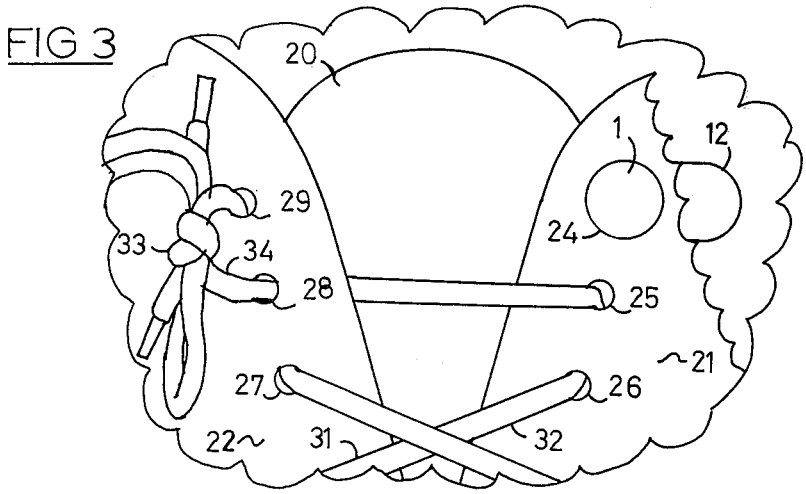
FIG. 3 is a plan view of the same upper portion of a lace shoe in the open position with the shoe material partially cut away.

The fastener illustrated comprises a button 1, having a central, threaded bore 2, a stem portion 3, and a substantially tapered portion 4 such that the button has a greater circumference at the top than at the bottom. Said tapered portion 4 and said stem 3 form the working surface which engages the shoelace in operation. The angle of taper of the tapered portion 4 with respect to the axis of the central bore 2 is best defined as that angle which, when the fastener is installed on the shoe, will provide for the effective retention of the shoelace about the fastener, while easily releasing the lace when it is grasped and pulled.

In testing the invention, I have found an angle of about 15 degrees to be suitable.

An annular recess 5, concentric with said threaded bore 2 is provided on the bottom surface of the button to accommodate an embossed eyelet and permitting the bottom edge 6 of the button to be flush with the shoe material, preventing the lace from becoming wedged thereunder.

The bottom edge 6 is serrated or knurled in order to prevent the button from unscrewing in use.

The blind end 7 of said threaded bore 2 is sufficiently thin in cross-section to permit it to be broken or stretched by stud 4, if necessary to permit the button to be fastened down properly on a shoe having exceptionally thin material at the eyelet.

The button 1 is fastened onto the shoe upper by being screwed onto threaded stud 11 which is integral with and situated eccentrically on the long axis of a substantially flat, elongated supporting base 10, so that the base has an elongated portion 12.

A plurality of small pointed projections 13 on the upper surface of the base 10 engages the shoe material to inhibit the base from turning.

I prefer to make the threads of stud 11 and bore 2 of such relative dimensions that a pressure fit is formed between them, thereby inhibiting the fastener from becoming unscrewed while in use.

I further prefer to make the stud 11 of a diameter small enough to be able to pass through the smallest standard shoe eyelets in common use, and have found a diameter of approximately ⅛ inch to be suitable. I also prefer to make the fastener of polyamide (nylon) as extensive testing has shown that a stud of ⅛ inch diameter has adequate strength and durability when made of this material.

I further prefer polymide (nylon) as tests have shown that when the base 10 is of this material and approximately 1 inch long, ½ inch wide and 1/16 inch thick, it adopts a curvature, as a consequence of its support function, which is compatible with the curvature of the shoe surface. It is consequently unnecessary to build the curvature into the mold used to manufacture the fastener thereby saving on production costs.

I prefer to install the fastener in the top eyelet 24 of one flap 22 of a shoe closure. The base 10 is placed between the tongue 20 and the flap 22 with the stud 11 projecting through the eyelet 24 and the button 1 is then screwed tightly onto the stud 11.

The elongated portion 12 of the base 10 points away from the other flap 20 of the closure in order to prevent the pull exerted by the loop of shoelace 34 from tipping the button 10 and in particular to do so by exerting pressure upwards into the shoe flap 22 rather than downwards into the tongue 20, creating a pressure point on the foot.

While a variety of lacing arrangements may be used to provide a loop of lace 34 to engage the button 1, I have found that some of these arrangements may, on certain shoes, not permit the flaps 21 and 22 to be spread widely enough. Consequently, I have developed a preferred lacing pattern which permits a separation of the flaps 21 and 22 which is adequate for all but the exceptional case and which, in addition, appears substantially normal, is appliable to all lace shoes with 3 or more pairs of eyelets, and incorporates a slip ratio between the two strands of lace 31 and 32 such that, if it is desired to tie the knot 33 in the conventional position, the knot will not jam into eyelet 28 or 29 on fully separating the claps 21 and 22.

My preferred lacing pattern is as follows: In a conventionally laced shoe, the laces are pulled out of the top three pairs of eyelets. One strand of lace, 31 enters 3rd eyelet 27 from the outside and emerges from first eyelet 29. The other strand of lace 32, enters third eyelet 26 from the top, emerges from second eyelet 25, crosses over to the other second eyelet 28, entering it from the underside, forms a loop 34 around the button 1 and is tied into a knot 33 on the conventional location.

The knot may equally well be tied at the bottom of the lacing, near the toes, if desired.

I claim:

1. A fastener for lace shoes and the like having flaps with lace holes and a tied lace, comprising a substantially flat base portion, a stem extending substantially perpendicularly upward from said base portion to an upper end thereof, a button portion having a lower surface, a lower end, an upper end and an upper surface, attachment means for attaching said button portion to said stem comprising a screw thread, located around said upper end of said stem and a correspondingly threaded bore in said lower surface of said button portion, said stem being of a size suitable to permit said stem to be inserted through one of said lace holes in one of said flaps from an inside surface of said flap, means for retaining said base portion in chosen orientation on said flap, comprising said threaded bore in said button portion extending internally of said button portion almost to said upper surface, the remaining thickness of material at end of said bore being sufficiently thin to permit said upper end of said stem to break through said remaining thickness of material in order to draw up said base portion firmly toward said lower surface of said button portion upon said flap being exceptionally thin, said tied lace having a free loop, means for selectively retaining a portion of said loop around said button portion and selectively permitting said portion of said loop to be removed from said button portion by said loop portion being pulled upward and away therefrom, means for preventing inadvertent disengagement of said button portion from said stem, comprising a pressure fit between said threads in said button portion and said threads on said stem, and means to facilitate relocation of said loop portion around said button portion upon said loop portion having been removed therefrom.

2. A fastener for lace shoes and the like as claimed in claim 1 in which said means for selectively retaining a portion of said loop around said button portion and selectively permitting said portion of said loop to be removed from said button portion by said loop portion being pulled upward and away therefrom comprises said button portion being substantially cylindrical at said lower end, a tapered portion of said button continuing from said cylindrical portion substantially toward said upper end, the diameter of said tapered portion being greater at said upper end of said button portion than the diameter of said tapered portion at said lower end of said button portion, the angle of said tapered portion with respect to an axis of said tapered portion being between 10° and 25°, said means for retaining said base portion in chosen orientation on said flap comprising at least one small projection extending upward from said base portion, said at least one projection being adapted to penetrate into said inside surface of said flap upon said button portion being firmly attached to said stem.

* * * * *